United States Patent [19]

Hoch

[11] 4,118,837

[45] Oct. 10, 1978

[54] BUCKLE FOR A BELT AND THE LIKE

[75] Inventor: Fritz Hoch, Pforzheim, Fed. Rep. of Germany

[73] Assignee: Gutos Metallschliessenfabrik Bader & Hoch KG, Pforzheim, Fed. Rep. of Germany

[21] Appl. No.: 808,144

[22] Filed: Jun. 20, 1977

[51] Int. Cl.[2] ..... A44B 11/25

[52] U.S. Cl. ..... 24/75; 24/78; 24/163 R

[58] Field of Search ..... 24/68 E, 73 BB, 73 BC, 24/73 BH, 75, 77 R, 78, 132, 163, 188, 191, 213, 163 R

[56] References Cited

U.S. PATENT DOCUMENTS

| | | | |
|---|---|---|---|
| 2,030,018 | 2/1936 | Mouilbau | 24/75 X |
| 2,287,308 | 6/1942 | Hill | 24/75 |
| 2,324,430 | 7/1943 | Schalet et al. | 24/75 X |

*Primary Examiner*—Louis K. Rimrodt

*Attorney, Agent, or Firm*—Michael J. Striker

[57] ABSTRACT

A buckle for a belt or the like has two buckle members detachably connectable with each other and each adapted to retain a respective end portion of the belt. Each of the buckle members include a first portion detachably connectable with a first portion of the other buckle member, and a second portion adapted to confine the end portion of the belt therein. The second portion of the buckle member has at least two sections movable relative to each other between a first position in which the end portion of the belt is firmly retained in the second portion of the buckle member, and a second position in which the end portion of the buckle is released so as to be removable from the buckle member. Means are provided for arresting the sections of the second portion in the first position. The arresting means include a pivotable arresting element operative for urging the sections of the second portion into said first position.

24 Claims, 7 Drawing Figures

BUCKLE FOR A BELT AND THE LIKE

BACKGROUND OF THE INVENTION

The present invention relates to a buckle for a belt and the like. More particularly, it relates to such a buckle which comprises two buckle members each having a first portion detachably connectable with a first portion of the other buckle member, and a second portion adapted to confine a respective end portion of the belt.

Buckles of this general type have been proposed in the art. In such a buckle a second portion for confining an end portion of the belt is integral and stationarily connected with the end portion of the belt. In order to connect the end portion of the belt with the buckle member the end portion is inserted into a hole provided in the second portion of the buckle member, and the above second portion is inwardly squeezed so as to clamp the end portion of the belt therein.

A disadvantage of such a buckle is that the end portion of the belt is not detachably connected with the buckle element but is mounted stationarily relative to the latter, in which case the belt once connected to the buckle cannot be readily disconnected therefrom. However, in practice users of belts in many cases want to replace one belt by another having a different color, texture and/or construction, while at the same time being able to use the same buckle. The known buckles of the type under discussion do not provide for a possibility to remove the belt from the buckle and to connect a new belt with the latter.

Another disadvantage of the known buckles is that connection of the belt to the buckle includes the above mentioned complicated squeezing operation which can be performed only with the use of special tools.

SUMMARY OF THE INVENTION

Accordingly, it is an object of the present invention to provide a buckle for a belt and the like which avoids the disadvantages of the prior art buckles.

More particularly, it is an object of the present invention to provide a buckle for a belt and the like which permits easy connecting of an end portion of the belt with the buckle.

Another object of the present invention is to provide a buckle for a belt and the like which permits detachably connecting the belt with the buckle.

Still another object of the present invention is to provide a buckle for a belt and the like which permits easy removal of the belt from the buckle and connecting a new belt with the same buckle.

An additional object of the present invention is to provide a buckle for a belt and the like which permits removal of the belt from the buckle and replacing the same with a new one so that the above operations can be performed in any easy and simple manner without application of a substantially large force or use of an additional tool.

In keeping with these objects and with others which will become apparent hereinafter, one feature of the present invention is that the buckle, in accordance with the invention, has two buckle members detachably connectable with each other and adapted to retain an end portion of a belt, each of which buckle members includes a first portion detachably connectable with a first portion of the other buckle member, and a second portion spaced from the first portion in the direction of elongation of the buckle member and having two sections movable relative to one another so as to retain or release the end portion of the belt. Arresting members are provided for arresting the sections of the second portion in a first position in which this portion retains the end portion of the belt.

Such construction provides for detachably connecting the belt with the buckle. The belt can be easily connected to the buckle by inserting the end portion of the belt between the movable sections and subsequently actuating the arresting means so as to arrest the sections in the position in which they retain the end portion of the belt. In order to remove the belt from the buckle and replace the former by a new belt, it suffices to release the arresting means and one of the sections, unimpededly remove the belt, insert a new belt between the sections and actuate the arresting means as mentioned above for clamping the end portion of the belt between the sections. These operations are performed easily and conveniently, and do not require an application of a large force or use of an additional tool.

One of the sections of the second portion is pivotable relative to the other section between the above first position in which the sections retain the end portion of the belt, and a second position in which the sections do not retain the end portion of the belt so that the latter can be removed from the buckle member. The arresting means include an arresting element movable between two further positions in which it urges the one section into the first or into the second position thereof, respectively.

Pivot means for pivotally mounting the one section and pivot means for pivotally mounting the arresting element are provided which are constructed as interengaging formations formed on the one section and the other section of the second portion, and on the arresting element and the other section of the second portion, respectively.

The one pivotable section of the second portion has a camming surface, and the arresting element has one portion movably engageable with the camming surface of the one section so as to urge the latter from the second into the first position for clamping the end portion of the belt.

Guiding means may be provided for guiding the arresting element during its pivotal movement which means are formed as interengaging projection and slot provided on the one section of the second portion and on the arresting element, respectively.

The one and the other section of the second portion are jaw-like, and at least one of them has means for engaging the end portion of the belt such as tooth-like projections, or alternating grooves and projections spaced from each other in the direction of elongation of the buckle member.

Means for gripping the arresting element is provided formed as a hole in which a tool may be inserted so as to grip the arresting element and to pivot the same in the respective position.

The other section of the second portion has two raised side portions spaced from each other in the direction transverse to the direction of elongation of the buckle member. On the one hand, a portion of the arresting element may be located between the above raised portions when the arresting element is in such a position in which it urges the one section to retain the end portion of the belt. On the other hand, the pivot means for pivotally mounting the one section and the arresting element may be formed in the above raised portions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
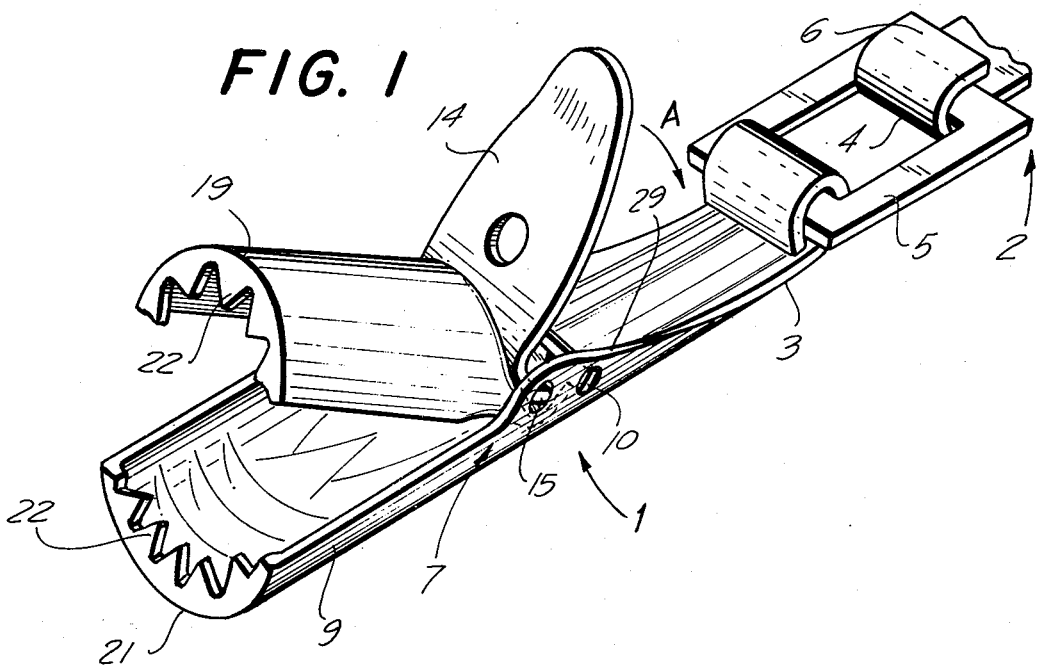
FIG. 1 is a perspective view of a buckle for a belt and the like in accordance with the present invention.

As shown in FIG. 1, a buckle for a belt and the like in accordance with the present invention, comprises two buckle members 1 and 2 having first portions 3 and 4 detachably connectable with one another. The first portion 3 of the buckle member 1 has a loop 5 which is engageable with a hook 6 formed on the first portion 4 of the buckle member 2.

Figure 6:
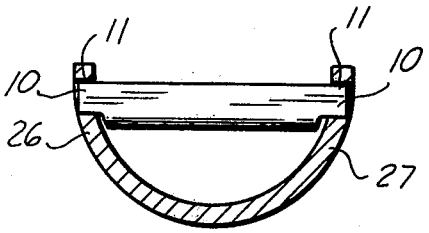
FIG. 6 is a section taken on the line I—I of FIG. 2.

The buckle member has a second portion 7 spaced from the first portion 3 and facing towards a not-shown end portion of a belt to be connected with the buckle. The second portion 7 includes one section 8 pivotable relative to the other section 9 thereof. Pivot means are provided pivotally mounting the one section 8 and including two projections 10 formed on the opposite sides of the one section 8 and two holes 11 formed in the other section 9 as shown in FIG. 6. Each hole 11 movably receives the respective projection 10 therein. The one section 8 is pivotable between a first position shown in FIG. 2 in which it clamps and firmly retains the end portion of the belt, and a second position shown in FIG. 1 in which the one section 8 is separated from the other section 9 so that the belt can be removed from the second portion 7. The one section 8 has a camming surface 12 provided with a guiding projection 13.

Figure 7:
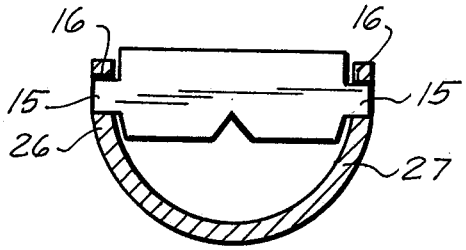
FIG. 7 is a section taken on the line II—II of FIG. 2.

An arresting element 14 is pivotable relative to the one section 8 and to the other section 9 of the second portion 7. Pivot means pivotally mounting the arresting element 14 are shown in FIG. 7 and include two projections 15 formed on the opposite sides of the arresting element 14, and two holes 16 formed in the other section 9 of the second portion 7. The arresting element 14 has a portion 17 movably engageable with the camming surface 12 of the one section 8. The camming surface 12 of the one portion 8 and the portion 17 of the arresting element 14 are so constructed that when the arresting element 14 moves in the direction of the arrow A from its second position shown in FIG. 1 into its first position shown in FIG. 2, the arresting element 14 urges the one section 8 from the second position of the latter shown in FIG. 1 into the first position of the section 8 shown in FIG. 2. In this case, the sections 8 and 9 approach one another, and the end portion of the belt is clamped between the one section 8 and the other section 9 of the second portion 7. Contrary to this, when the arresting element 14 moves in the direction which is opposite to the direction of the arrow A, the arresting element 14 releases the one section 8 so that the latter can be moved in its second position shown in FIG. 1 and thereby the end portion of the belt can be removed from the second portion 7 of the buckle member.

As shown in FIG. 1, the projections 10 of the means pivotally mounting the one section 8 are formed on an end portion 18 of the latter which is spaced from an end portion 19 facing towards the end portion of the belt. The projections 15 and the holes 16 of the means pivotally mounting the arresting element 14 is located intermediate the projections 10 and the holes 11, and the end portion 19 of the one section 8.

Figure 2:
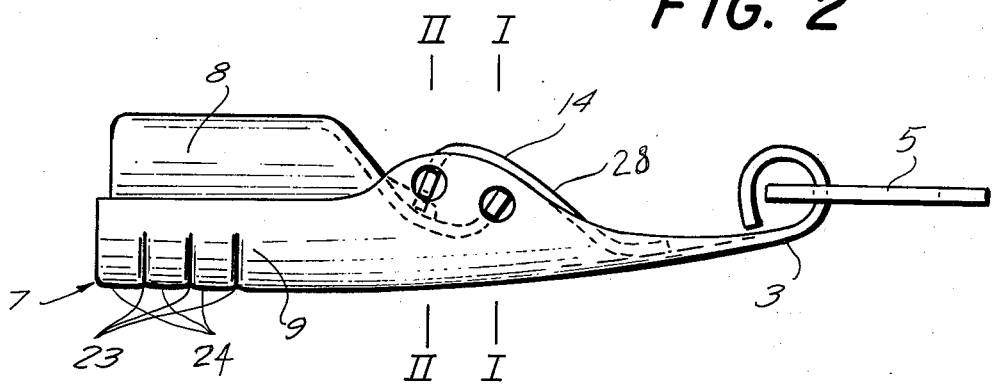
FIG. 2 is a side view of one of the buckle members of a buckle in accordance with the invention.

The arresting element 14 has a slot 20 movably engaging the projection 13 formed on the camming surface 12 of the one section 8. The interengaging projection 13 and slot 20 serve for guiding the arresting element 14 during its movement between the first and the second position thereof. When the arresting element 14 is in its first position that is urges the one section 8 in the position in which the latter retains the end portion of the belt, the portion 17 of the arresting element 14 is located intermediate the pivot means of the arresting element 14 including the projections 15 and holes 16, and the end portion 19 of the one section 8, as shown in FIG. 2.

The end portion 19 of the one section 8 and an end portion 21 of the other section 9 are jaw-like. Means for engaging the end portion of the belt may be provided on at least one of said end portions 19 and 21. The above engaging means may include tooth-like projections 22, and alternating projections 23 and grooves 24 spaced from each other in the direction of the elongation of the buckle member. The projections 23 may be formed for instance on the section 9 and face towards the section 8. It is understood that the above engaging means may be provided simultaneously or separately from each other, and may be formed either on one of the end portions 19 or 21, or on both of them.

Figure 3:
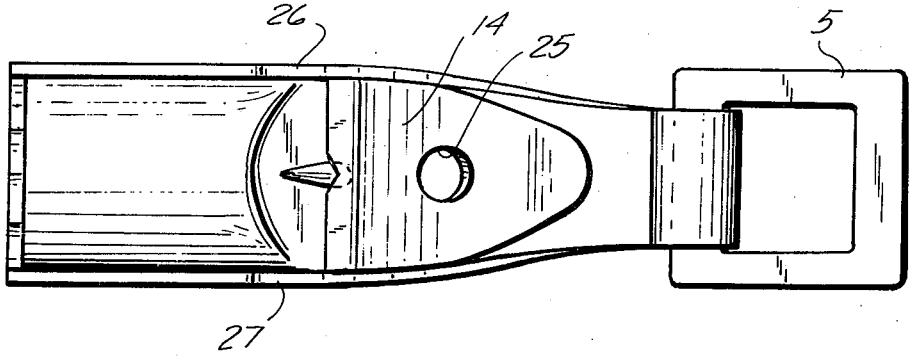
FIG. 3 is a top view of one of the buckle members of a buckle in accordance with the invention.
Figure 4:
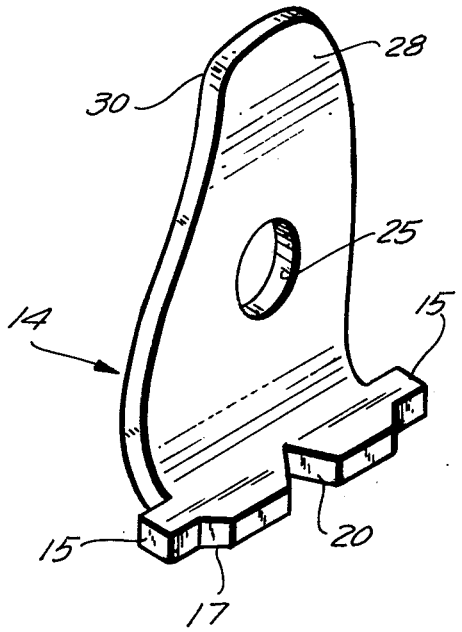
FIG. 4 is a perspective view of a movable section of a buckle member in accordance with the invention.
Figure 5:
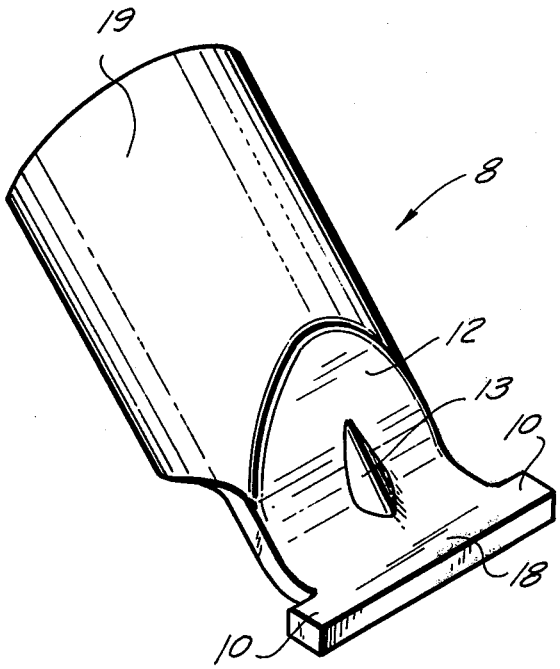
FIG. 5 is a perspective view of an arresting element of a buckle member in accordance with the invention.

The arresting element 14 has a hole 25 in which a tool such as a pin may be inserted so as to grip the arresting element 14 and to pivot the latter from the first position into the second position thereof. As shown in FIGS. 1 - 3, the other section 8 has two raised portions 26 and 27 spaced from each other in a direction transverse to the direction of elongation of the buckle member. When the arresting element 14 is in its first position its portion 28 is located between the above raised portions 26 and 27 so as to bridge a distance therebetween. The holes 11 and 16 which receive therein the projections 10 and 15 of the means for pivotally mounting the one section 8 and the arresting element 14, respectively, are formed in the above raised portions 26 and 27 of the other section 9. The raised portions 26 and 27 have surfaces 29 which are inclined towards the first portion 3 of the buckle member. When the arresting element 14 is in its first position as shown in FIG. 2, it is inclined towards the first portion 3 of the buckle member at an angle which is substantially equal to the angle of inclination of the surfaces 29 towards the same. The end portion 30 of the arresting element 14 may be bent relative to the remainder thereof.

In order to connect an end portion of a belt and the like with a buckle of the above described construction, the arresting element 14 is moved in a direction opposite to the direction identified by the arrow A. This results in that the portion 17 of the arresting element 14 slides over the camming surface 12 of the one section 8, the one section 8 is released and is moved by the user away from the other section 9. Thereafter, the end portion of the belt is inserted into a space formed between the sections 8 and 9, the arresting element is moved by the user in the direction of the arrow A so that the portion 14 thereof slides backwards over the camming surface 12 of the one section 8. The one section 8 is thereby urged into the position shown in FIG. 2 so that the end portion of the belt is clamped between the sections 8 and 9 and is firmly retained by the above portions, as well as by the projections 22 and 23 formed thereon. The arresting element 14 arrests the one section 8 in the above position shown in FIG. 2. The portion 17 of the arresting element 14 in this position abuts against the camming surface 12 of the one section 8, whereas the portion 28 of the arresting element 14 is located between the raised portions 26 and 27 of the other section 9.

It will be understood that each of the elements described above, or two or more together, may also find a useful application in other types of constructions differing from the types described above.

While the invention has been illustrated and described as embodied in a buckle for a belt and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A buckle for a belt and the like, comprising two elongated buckle members each adapted to retain a respective end portion of the belt, each of said buckle members including a first portion detachably connectable with the corresponding first portion of the other buckle member, and a second portion spaced from the respective first portion in the direction of elongation of the buckle member and adapted to confine the end portion of the belt therein, said second portion having at least two sections one of which is movable relative to another between a first position in which the end portion of the belt is firmly retained between said two sections and a second position in which the end portion of the belt is released so as to be removable from said buckle member, each respective buckle member further including means for urging said one section into and arresting it in said first position, said means including an arresting element movable between an operative position in which said arresting element urges said one section into and arrests it in said first position thereof so as to retain the end portion of the belt, and a release position in which said arresting element releases said one section so that the latter is movable into said second position thereof to thereby release the end portion of the belt.

2. The buckle as defined in claim 1, wherein said one section of said second portion is pivotable relative to said other section thereof; and further comprising pivot means for pivotally mounting said one section for pivoting between said first and second position.

3. The buckle as defined in claim 2, wherein said pivot means include interengaging formations formed on said one section of said second portion and on said other section thereof, respectively.

4. The buckle as defined in claim 3, wherein said interengaging formations include two projections formed on said one section and spaced from one another in a direction substantially transverse to the direction of elongation of said buckle member, and two holes formed in said other section and each movably receiving the respective one of said projections therein.

5. The buckle as defined in claim 3, wherein said one section has a first end portion facing towards the end portion of the belt, and a second end portion spaced from said first end portion in the direction of elongation of said buckle member, said projections being formed on said second end portion of said one section.

6. The buckle as defined in claim 2, wherein said arresting element is pivotable between said operating position and said release position; and further comprising further pivot means pivotally mounting said arresting element for pivoting between said further first and said further second positions.

7. The buckle as defined in claim 6, wherein said one section has a first end portion facing towards the end portion of the belt, said further pivot means of said arresting element being located intermediate said pivot means of said one section and said first end portion of the latter.

8. The buckle as defined in claim 7; and further comprising means for guiding said arresting element during its movement between said operative and said release positions, said guiding means including additional interengaging formations formed on said arresting element and said one section of said second portions, respectively.

9. The buckle as defined in claim 8, wherein said additional interengaging formations include at least one additional projection formed on said one section and extending substantially in the direction of elongation of said buckle member, and at least one slot formed in said arresting element and extending substantially in the direction in which said additional projection extends, said additional projection of said one section being movably engageable with said slot of said arresting element during movement of the latter between said operative and release position.

10. The buckle as defined in claim 7, wherein said arresting element has means for gripping thereof so as to pivot said arresting element between said further first and further second position.

11. The buckle as defined in claim 10, wherein said gripping means include at least one hole formed in said arresting element and operative to receive a tool therein.

12. The buckle as defined in claim 6, wherein said one section has a camming surface, said arresting element having one portion movable relative to said camming surface of said one section and in engagement therewith when pivoted from said further second into said further first position so as to urge said one section from said second into said first position thereof.

13. The buckle as defined in claim 12, wherein said other section of said second portion has two raised side portions spaced from each other in a direction transverse to the direction of elongation of said buckle member at a predetermined distance, said arresting element having the other portion spaced from said one portion and located between said raised side portions so as to bridge said distance therebetween, when said arresting element is in said operative position thereof.

14. The buckle as defined in claim 13, wherein each of said raised side portions has a surface facing and inclined towards said first portion of said buckle at a predetermined angle, said other portion of said arresting element being inclined towards said first portion of said buckle member at an angle substantially equal to the angle at which said raised portions are inclined towards the same, when said arresting element is in said operative position thereof.

15. The buckle as defined in claim 12, wherein said one section has a first end portion facing towards the end portion of the belt, said one portion of said arresting element being located between said further pivot means of the latter and said first end portion of said one section, when said arresting element is in said operative position thereof.

16. The buckle as defined in claim 6, wherein said further pivot means include further interengaging formations formed on said arresting element and on said other section of said second portion, respectively.

17. The buckle as defined in claim 16, wherein said further interengaging formations include two further projections formed on said arresting element and spaced from each other in a direction substantially transverse to the direction of elongation of said buckle member, and two further holes formed in said other section of said second portion and each movably receiving the respective one of said further projections therein.

18. The buckle as defined in claim 1, wherein said one section and said other section of said second portion each has a first end portion facing towards the end portion of the belt, said first end portions being jaw-like.

19. The buckle as defined in claim 18, wherein at least one of said first end portions is provided with means for engaging the end portion of the belt.

20. The buckle as defined in claim 19, wherein said engaging means include tooth-like projections extending in a direction substantially transverse to the direction of elongation of said buckle member.

21. The buckle as defined in claim 19, wherein said engaging means include alternating projections and grooves spaced from each other in the direction of elongation of said buckle member.

22. The buckle as defined in claim 1, wherein said other section of said second portion has raised side portions spaced from each other in a direction substantially transverse to the direction of elongation of said buckle member, one of said sections of said second portion being pivotable relative to the other section thereof, said arresting means including at least one arresting element pivotable relative to said one section of said second portion; and further comprising pivot means pivotally mounting said one section; and further comprising further pivot means pivotally mounting said arresting element, at least part of said pivot means and said further pivot means are formed in said raised side portions of said other section.

23. The buckle as defined in claim 1, wherein said buckle members are detachably connectable with each other; and further comprising means in said first portion off one buckle member and in said first portion of said other buckle member operative for detachably connecting said buckle members with each other.

24. The buckle as defined in claim 23, wherein said connecting means include a loop and a hook each mounted on the first portion of the respective buckle members and engageable with one another.

* * * * *